United States Patent [19]

Pavelin

[11] Patent Number: 4,829,412

[45] Date of Patent: May 9, 1989

[54] SPOTLIGHT ARRANGEMENT

[75] Inventor: Ernest J. Pavelin, Harlow, England

[73] Assignee: Thorn EMI plc, London, England

[21] Appl. No.: 94,995

[22] Filed: Sep. 10, 1987

[30] Foreign Application Priority Data

Sep. 10, 1986 [GB] United Kingdom ..... 8621848

[51] Int. Cl.[4] ..... F21V 13/04

[52] U.S. Cl. ..... 362/294; 362/304; 362/305; 362/331

[58] Field of Search ..... 362/294, 295, 304, 305, 362/328, 331, 351, 355, 361

[56] References Cited

U.S. PATENT DOCUMENTS 1,525,369 2/1925 Campbell ..... 362/294

1,959,819 5/1934 Duane ..... 362/305

2,300,523 11/1942 Reichart ..... 362/294

3,141,086 7/1964 Prager ..... 362/304

*Primary Examiner*—Ira S. Lazarus

*Assistant Examiner*—Sue Hagarman

*Attorney, Agent, or Firm*—Fleit, Jacobson, Cohn & Price

[57] ABSTRACT

A spotlight comprises a light source (14) mounted within a enclosure (11) fitted with a light-transmissive cover (28) which is formed with a central opening (29) above the light source. A clearance space between the light source and the cover allows light from light source (14) to spill over into the enclosure and thereby illuminate the cover from behind. Another enclosure (12) containing control gear (17) for the light source is thermally insulated from enclosure (11) by an air gap (21).

4 Claims, 2 Drawing Sheets

SPOTLIGHT ARRANGEMENT

This invention relates to an improved spotlight arrangement. The PAR 38 lamp marketed by the Applicant company, is a sealed beam incandescent light source provided with a parabolic reflector which is usually aluminised. Three types of reflector lamps are in general use providing a narrow, medium or wide beam. Although the PAR 38 can be used as a floodlight its primary use is as a spotlight, in which case the light source is fitted with a borosilicate glass stippled cover over the front face. The PAR 38 lamp is supplied in the range 100–150 W and there are many in use. If a PAR 38 lamp fails and needs to be replaced then it is necessary to replace the complete lamp.

Another lamp which is successfully marketed by the Applicant company is the low voltage spotlight sold under the trade mark Lightstream. This is a tungsten halogen incandescent filament fitted integrally within a facetted mirror reflector. Because of the greater efficiency of the tungsten halogen lamp it is found that, as far as light output is concerned, a 50 W Lightstream lamp could be readily substituted for the 100–150 W PAR 38 lamp in existing fittings. Moreover since there are many PAR 38 lamps in use, if a spotlight simulating the PAR 38 could be provided there would be a large retrofit market for such lamps.

An object of this invention is to integrate a tungsten halogen incandescent lamp within the housing of a PAR 38 or similar type of incandescent lamp to be an effective replacement therefor.

In its broadest aspect the invention provides a spotlight comprising an enclosure; a light-transmissive cover for said enclosure, the cover having a central opening; and a light source mounted within the enclosure directly beneath the central opening, there being a clearance space between the light source and the cover which allows light from the light source to enter the enclosure and thereby illuminate the cover from behind.

Figure 1:
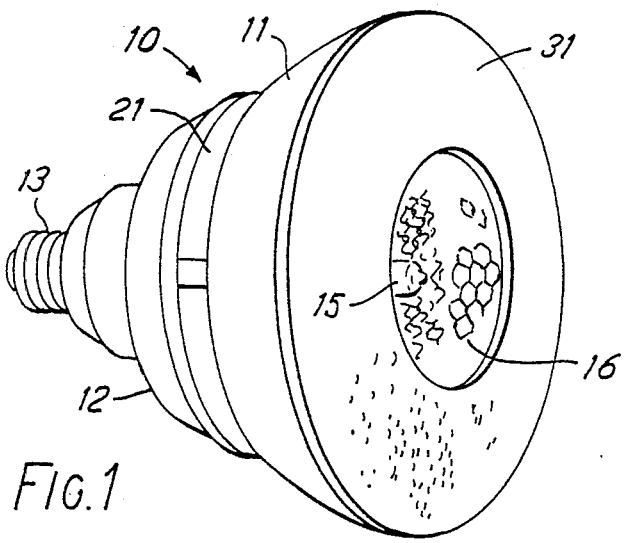
Figure 3:
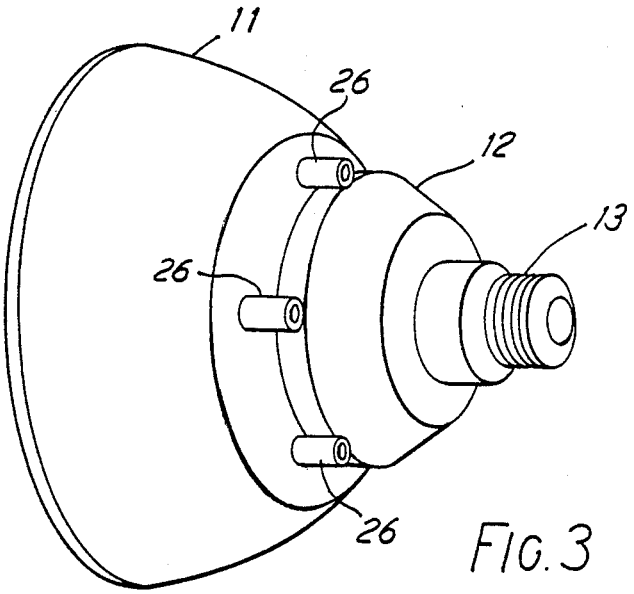
Figure 2:
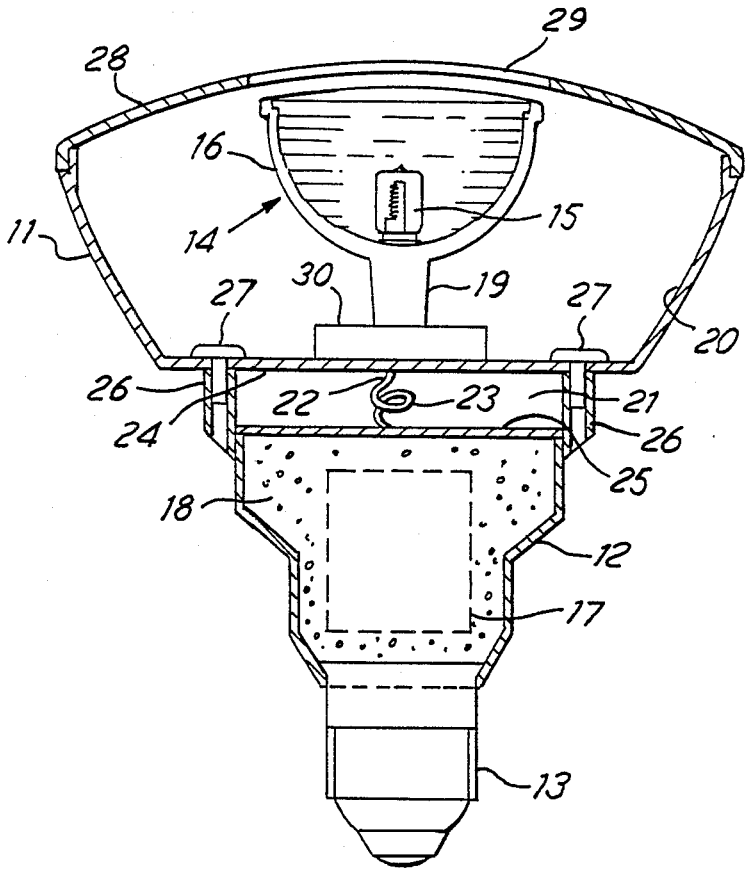

The invention will now be described by way of example only with reference to the accompanying drawings wherein:

FIG. 1 is a perspective end view on the front of a spotlight in accordance with the invention, FIG. 2 is a part sectional elevation of a spotlight in accordance with the invention, FIG. 3 is a perspective end view on the rear of a spotlight in accordance with the invention.

In FIG. 1 reference numeral 10 indicates a spotlight generally in accordance with the present invention comprising a first enclosure member 11 and a second enclosure member 12 which terminates in an Edison screw terminal 13. As best seen in FIG. 2, first enclosure 11 houses a light source 14, in the form of a tungsten halogen incandescent filament lamp 15 integral with a facetted mirror reflector 16, this light source being marketed by Appliant company under the trade mark Lightstream. Also as shown in FIG. 2, second enclosure 12 houses electronic circuitry represented diagrammatically by dotted lines 17 which is required to run light source 15. The control gear 17 is surrounded by potting compound for cooling. In order to keep heat generated by the tungsten halogen lamp 15 away from electronic circuitry 17, enclosure 11 with aluminised reflector surface 20, is formed free of any openings so that heat will not flow rearwardly. Moreover, in order to minimise heat transfer between the first and second enclosures 11, 12 respectively an air gap 21 is formed between them. As an additional aid to this end control wire 22 connecting lamp 15 with electronic circuitry 17 is formed with a loop 23 which is placed within air gap 21. By this means it is found that a temperature differential of approximately 80 centigrade degrees can be maintained between bottom 24 of first enclosure 11 and top 25 of second enclosure 12. Structural connection between the first and second enclosures 11, 12 is made by hollow leg members 26 attached to second enclosure 12 and by pin members 27 as best seen in FIG. 2. This arrangement also tends to reduce heat transfer from the light source pinch 19 to the heat sensitive electronic circuitry 17.

A cover member 28 of light transmitting polycarbonate material snap fits to reflector 20 to complete enclosure 11. Cover 28 has a stippled surface which forms a light reflecting surface and complements the facetted surface of reflector 16 as best seen in FIG. 1. Cover 28 has clearance opening 29 through which reflector lamp 14 may be inserted into its holder 30 within enclosure 11. During operation of the reflector lamp 14 light, of course, projects through opening 29, however when viewed end-on as in FIG. 1, it is found that light unexpectedly appears to come also from the unlit portion 31 of cover 28 as well as the lit portion formed by opening 29. This means that the spotlight effect provided by the simulated PAR 38 substantially is the same as that provided by a true PAR 38. Because reflector lamp 14 is stepped back slightly from the cover 28 it is believed stray light beams penetrate the clearance space between cover 28 and the rim of reflector 16 and spill into the remainder of enclosure 11 not occupied by reflector lamp 14. It will be appreciated that with a simulated PAR 38 only the light source 14 needs to be replaced and housings 11 and 12 need not be replaced.

A typical embodiment of the present invention would utilise a 50 Watt Lightstream lamp with a 50 mm reflector but wattages range from 20 to 70 with two sizes of reflector available, namely 35 mm and 50 mm. Any combination of these could be used in the present invention. The overall diameter of the cover member is 120 mm on a 137.5 mm radius, with a 52 mm diameter opening. The overall length of the simulated PAR 38 is 136 mm and the length of the air gap between the first and second enclosing is 10 mm. The Lightstream lamp is stepped back approximately 2 mm from the inside of the cover.

What is claimed:

1. A spotlight comprising an enclosure, having a light-reflective, interior surface, a light-transmissive cover for said enclosure, the cover having a central opening; and a light source, comprising a mirror reflector having a rim and a lamp within the reflector, the light source being mounted within the enclosure directly behind the central opening; there being a clearance space between the rim of the reflector and the cover which allows light from the light source to enter the enclosure behind the cover and thereby illuminate the cover from behind.

2. A spotlight according to claim 1 including a further enclosure containing electrical circuitry for the light source, said enclosures being insulated thermally from one another by an air gap.

3. A spotlight according to claim 2 wherein said enclosures are interconnected structurally by a plurality of leg members.

4. A spotlight according to claim 2 wherein said light source and said electrical circuitry are interconnected electrically by a lead wire which has a looped configuration in said air gap.

* * * * *